US006011207A

United States Patent [19]

Hoshino

[11] Patent Number: 6,011,207

[45] Date of Patent: Jan. 4, 2000

[54] BEARING SUPPORT STRUCTURE, USEFUL FOR MUSICAL INSTRUMENT

[75] Inventor: Yoshihiro Hoshino, Moriyama Ku, Japan

[73] Assignee: Hoshino Gakki Co., Ltd., Nagoya, Japan

[21] Appl. No.: 09/150,912

[22] Filed: Sep. 10, 1998

[30] Foreign Application Priority Data

Jan. 29, 1998 [JP] Japan ..... 10-034071

[51] Int. Cl.[7] ..... G10D 13/02

[52] U.S. Cl. ..... 84/422.1; 84/422.3

[58] Field of Search ..... 84/422.1–422.4

[56] References Cited

U.S. PATENT DOCUMENTS 5,343,792 9/1994 Liao ..... 84/422.1

5,388,494 2/1995 Hoshino ..... 84/422.1

5,421,234 6/1995 Liao ..... 84/422.1

*Primary Examiner*—Jeffrey Donels

*Attorney, Agent, or Firm*—Ostrolenk, Faber, Gerb & Soffen, LLP

[57] ABSTRACT

A bearing support particularly useful in a musical instrument. The bearing has a shaft rotatable on its axis. The bearing has a periphery around the rolling elements. A support body has a hole in it for receiving the periphery of the bearing. A cut in the body extends from the edge of the body into the hole for defining two arms which are clampable together by a bolt and nut for tightening the arms of the body around the bearing periphery. The bearing may be a bearing in a pedal operated musical instrument and the bearing may be used at various locations in the instrument, e.g., at the attachment of the pedal to the base, at the attachment of the pedal to the operating shaft for the musical instrument or at the bearing for a swingable arm connected with the operating shaft.

12 Claims, 11 Drawing Sheets

BEARING SUPPORT STRUCTURE, USEFUL FOR MUSICAL INSTRUMENT

BACKGROUND OF THE INVENTION

This invention relates to a bearing support structure, useful for a pivot connection for a musical instrument.

Currently, a bearing may be employed instead of a conventional spring pin at the support of the operating part of a musical instrument device such as a drum pedal, a high hat stand, etc. As contrasted with an axial support structure based on a spring pin, the bearing improves the performance and operability of musical instruments because it permits smoother rotation.

As a spring pin has previously been provided at the support of the operating part of the musical instrument, however, a limited space is usually available so that a bearing with a small diameter, e.g. about 10 mm, is used.

An installation hole sized slightly larger than the diameter of the bearing to be mounted is formed in the body that receives the bearing for insertion of the bearing. However, there is usually a gap between the installation hole and the periphery of the bearing, causing shakiness during the performance.

The gap between the bearing and the installation hole is filled by pouring an adhesive agent into the gap. But, the foregoing method causes some problems in operability even though it eliminates shakiness of the bearing. It is extremely difficult to pour an adhesive agent into the small gap of the bearing. The adhesive tends to adhere to the surrounding area and sometimes penetrates into the bearing. During maintenance, moreover, a bearing that has been fixed in place with an adhesive agent is separated from the element to which it is adhered with difficulty. If the bearing is forced out, it tends to be damaged. During reconstruction, moreover, it becomes necessary to again fix the bearing by use of an adhesive agent. Since such maintenance work is carried out by the user, it becomes highly difficult from a technical point of view.

To avoid the need for an adhesive agent, it is possible to form the holding hole for the bearing to be of a small size beforehand and to then compressively force the bearing into it. However, the bearing may be damaged by compressive insertion and its rotatability may deteriorate because excessive pressure is applied to the interior of the bearing in some cases. In such a structure, precise management of the dimensions of the installation hole is important and, particularly in the case of a small size, precise management becomes all the more restrictive.

SUMMARY OF THE INVENTION

The object of the invention is to resolve the above described problem by providing an improved bearing support structure, particularly for use in a musical instrument device, which is capable of holding the bearing without shakiness at the operating part of musical instrument and which is easily removable.

The invention concerns the structure of a bearing support, e.g. for a musical instrument, wherein a cut is made in the bearing support body from an edge of the body and into the support hole in the support for the bearing. A tightening bolt is inserted between the arms defined by the cut and tightening the bolt tightly compresses the body on the bearing to hold the said bearing.

The bearing support structure is particularly useful in a musical instrument device. A bearing has a shaft rotatable on its axis and the bearing has an outer periphery around the rolling elements. A support body has a hole in it for receiving the periphery of the bearing. A cut in the body extends from the edge of the body into the hole for defining two arms which are clampable together by a bolt and nut for tightening the arms of the body around the bearing periphery.

The bearing may be a bearing in a pedal operated musical instrument, and the bearing may be used at various locations in the instrument, e.g., at the attachment of the pedal to the base, at the attachment of the pedal to the operating shaft for the musical instrument or at the bearing for a swingable arm connected with the operating shaft.

Other objects and features of the invention are explained below with reference to the attached drawings.

DESCRIPTION OF THE PREFERRED EMBODIMENTS

Figure 1:
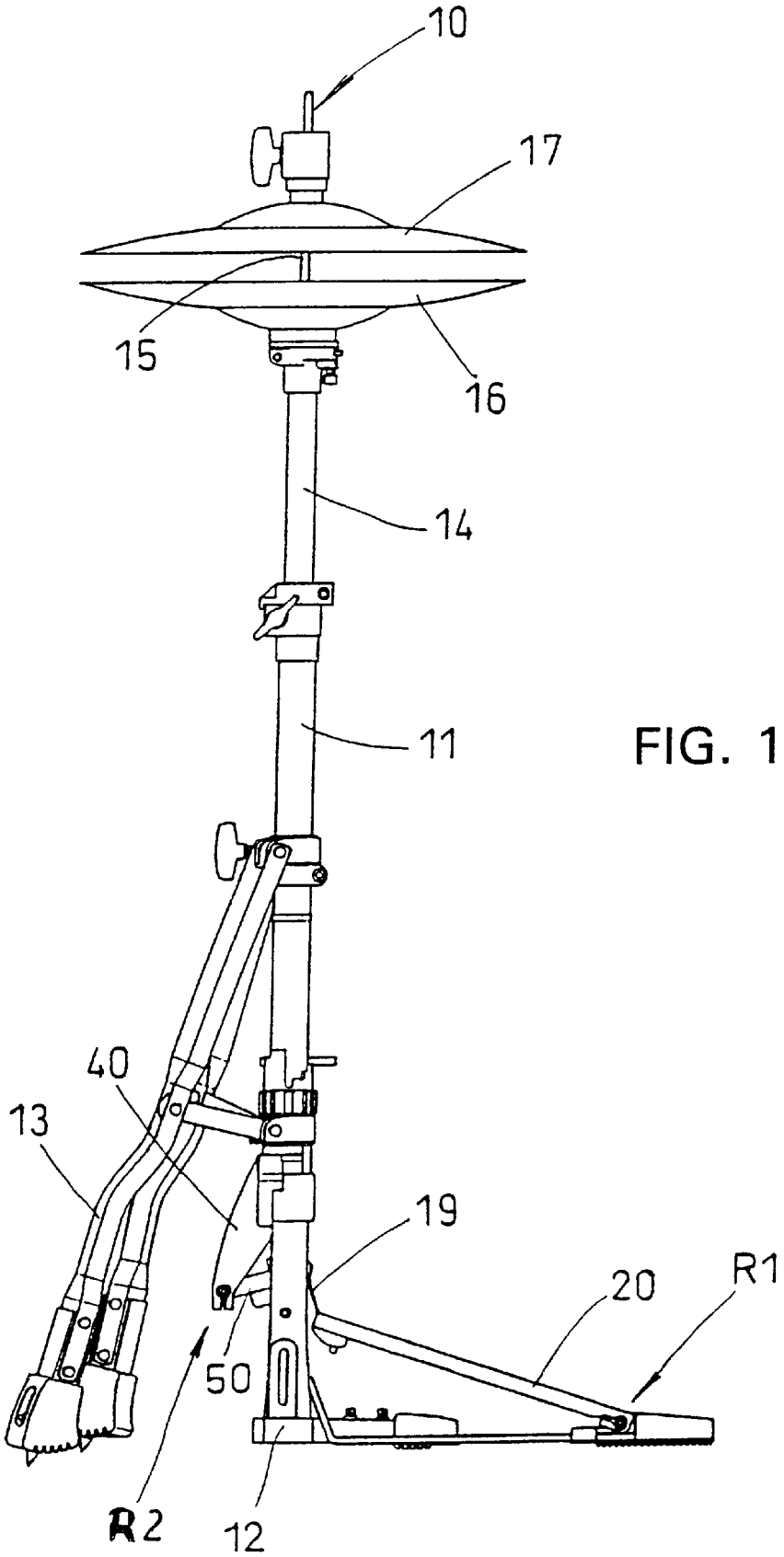
FIG. 1 is a side view of a high hat stand including the invention.

The invention relates to a bearing support structure particularly at the performing part of a musical instrument, such as a high hat stand 10 which is shown in FIG. 1, for example. The invention is useful with other musical instruments that include a pivot bearing, like a drum pedal, for example. The invention may be adapted to any apparatus having two parts which pivot with respect to each other at a pivot bearing.

In the illustrated high stand 10, a bearing is used both at the rotary shaft connecting the base to the foot pedal at R1 and at the rotary shaft part of the rotary support member at R2.

The stand has a support post 11, a support base 12 beneath the post 11, a pair of stand legs 13, an upper inner tube 14 for supporting a lower fixed cymbal 16, an operating rod 15 for supporting an upper movable cymbal 17 that is moved up and down by the operating rod 15, a link 19 connected to a foot pedal 20, a rotary support member 40 which is rotatably attached to a rotary arm 50 that is pivoted by the link 19.

The rotary axial part R1 of the foot pedal is now explained. The foot pedal 20 of the high hat stand 10 includes a pedal plate 21 which is pivoted to a heel plate 22, as shown in FIGS. 2 through 5. The tip of the pedal plate 21 is attached to a link 19 which is in turn linked to the rotary arm 50 so that the link rotates the rotary arm 50 by up and down operation of the pedal plate 21. This moves the operating rod 15 up or down through a chain 51 attached on the rotary arm 50. The rear end of the pedal plate 21 is freely rotatably installed by a bearing at the front end of the heel plate 22.

Figure 4:
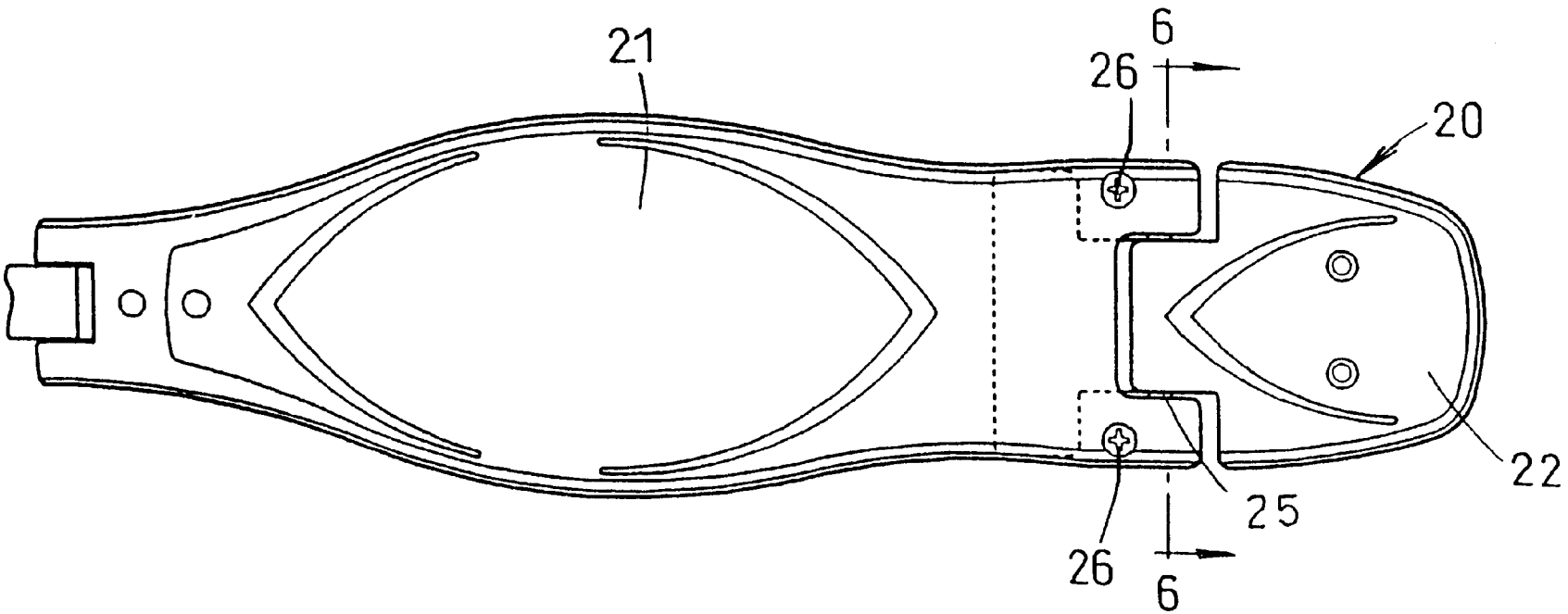
FIG. 4 is a top plan view showing the foot pedal.
Figure 5:
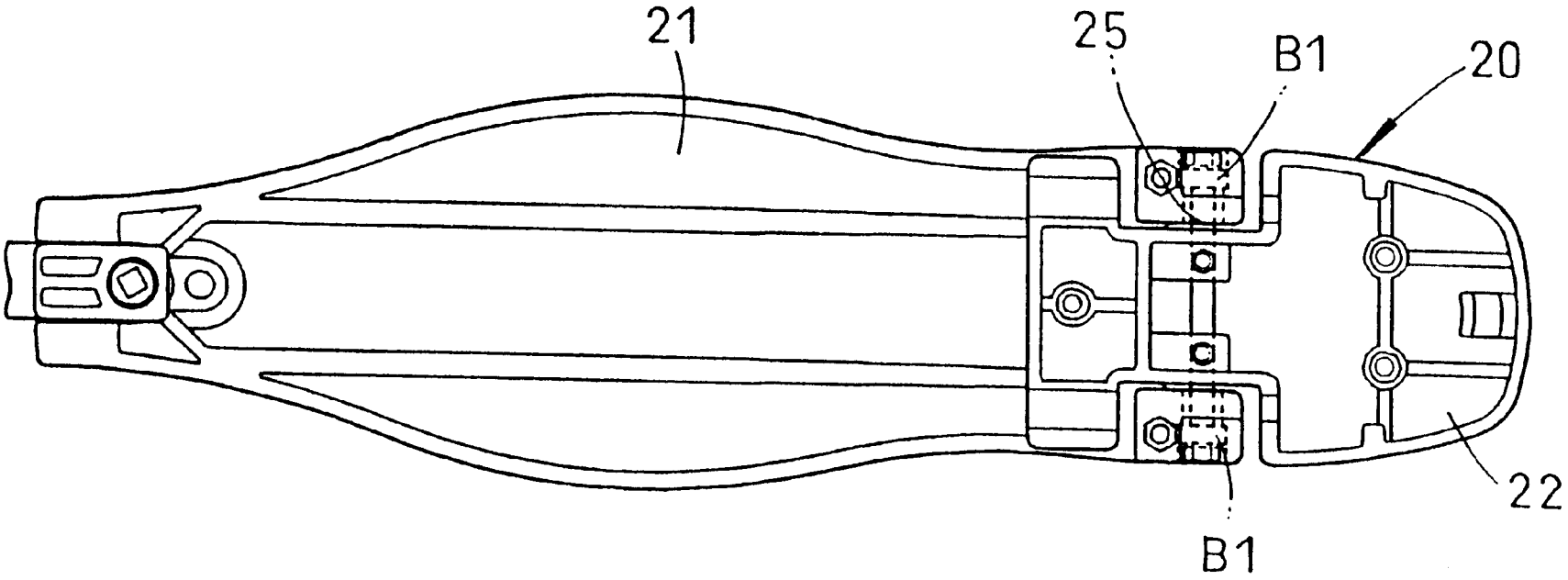
FIG. 5 is a bottom view of the foot pedal.
Figure 6:
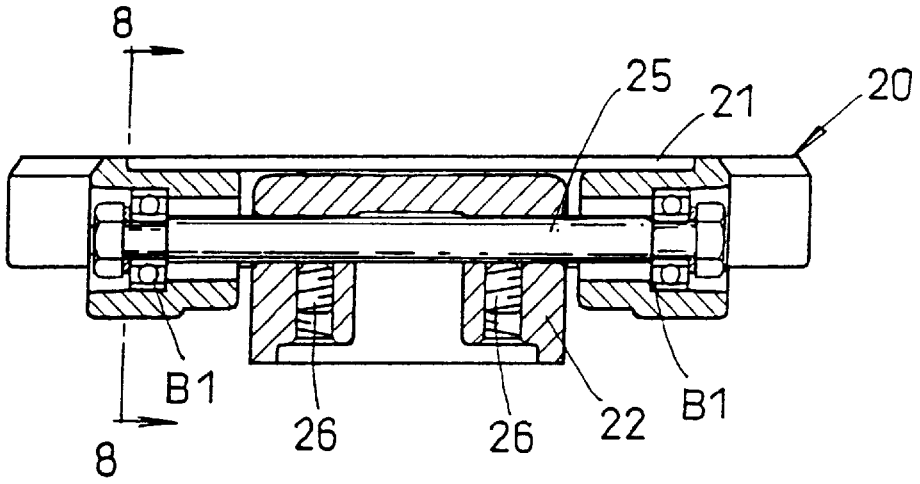
FIG. 6 is a cross section along line 6—6 in FIG. 4.

The rear of the pedal plate 21 and the front of the heel plate 22 are rotatably or pivotally connected through a foot pedal rotary shaft 25, shown in FIGS. 4 through 6. The shaft 25 is fixed at the heel plate 22 by fixing screws 26 in the plate 22 and is rotatably held through the bearings B1 at the pedal plate 21.

Figure 7:
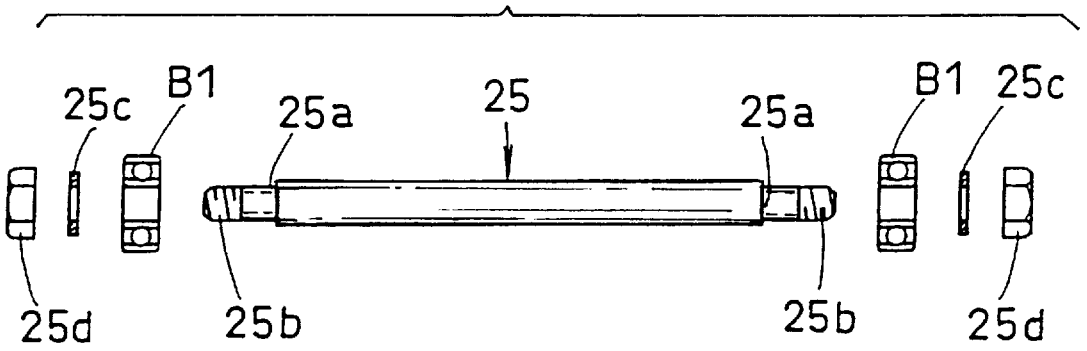
FIG. 7 shows the rotary shaft of the foot pedal.

As shown in FIGS. 6 and 7, the foot pedal rotary shaft 25 has opposite end regions that terminate in respective threaded end screws 25*b* of a small diameter and which meet the shaft 25 at the steps 25*a* at both ends. The bearings BE rest against the steps 25*a* and are sandwiched by the washers 25*c* and the tightening nuts 25*d* screwed onto each end.

Figure 8:
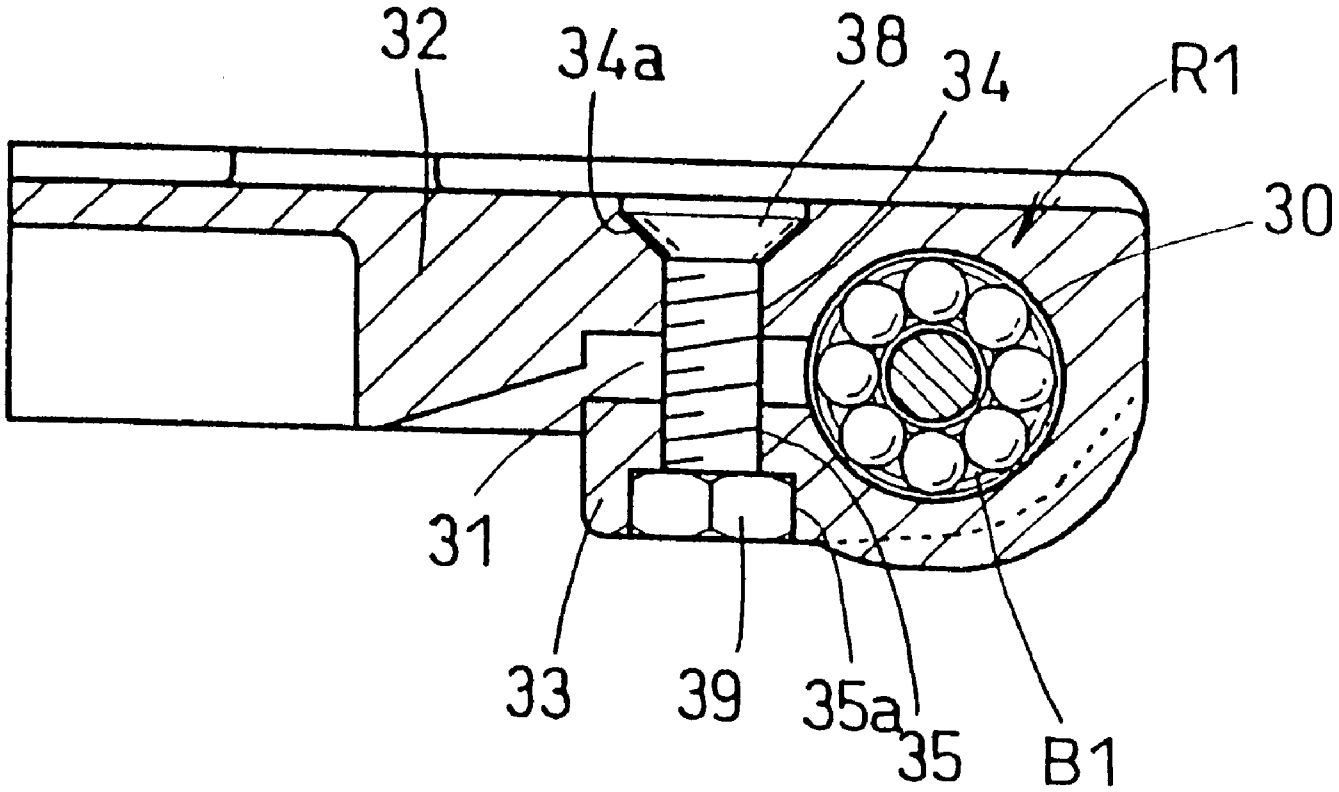
FIG. 8 is a partial cross section along line 8—8 in FIG. 6.
Figure 9:
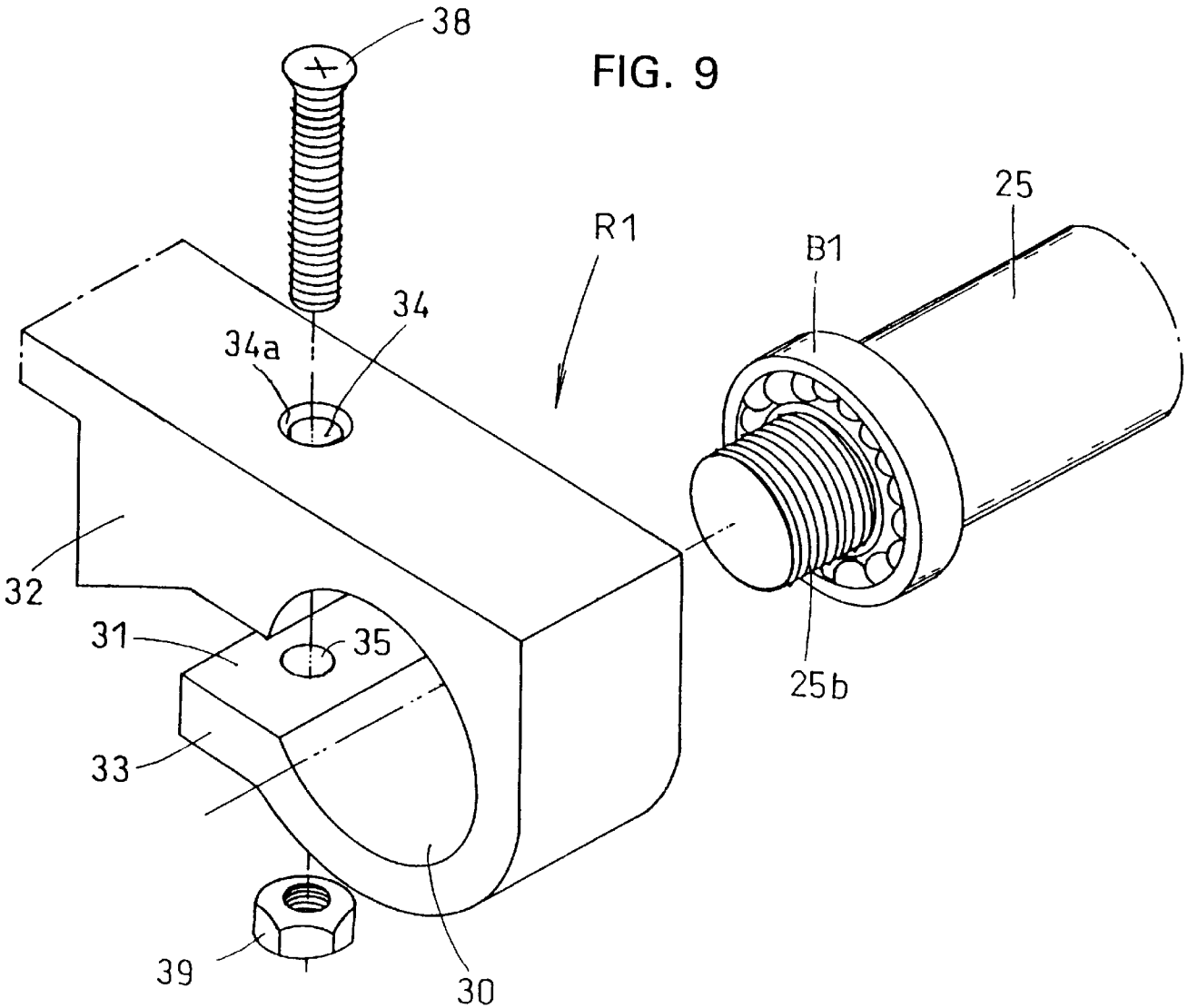
FIG. 9 is an oblique exploded view of an essential part of the bearing support for the foot pedal.
Figure 10:
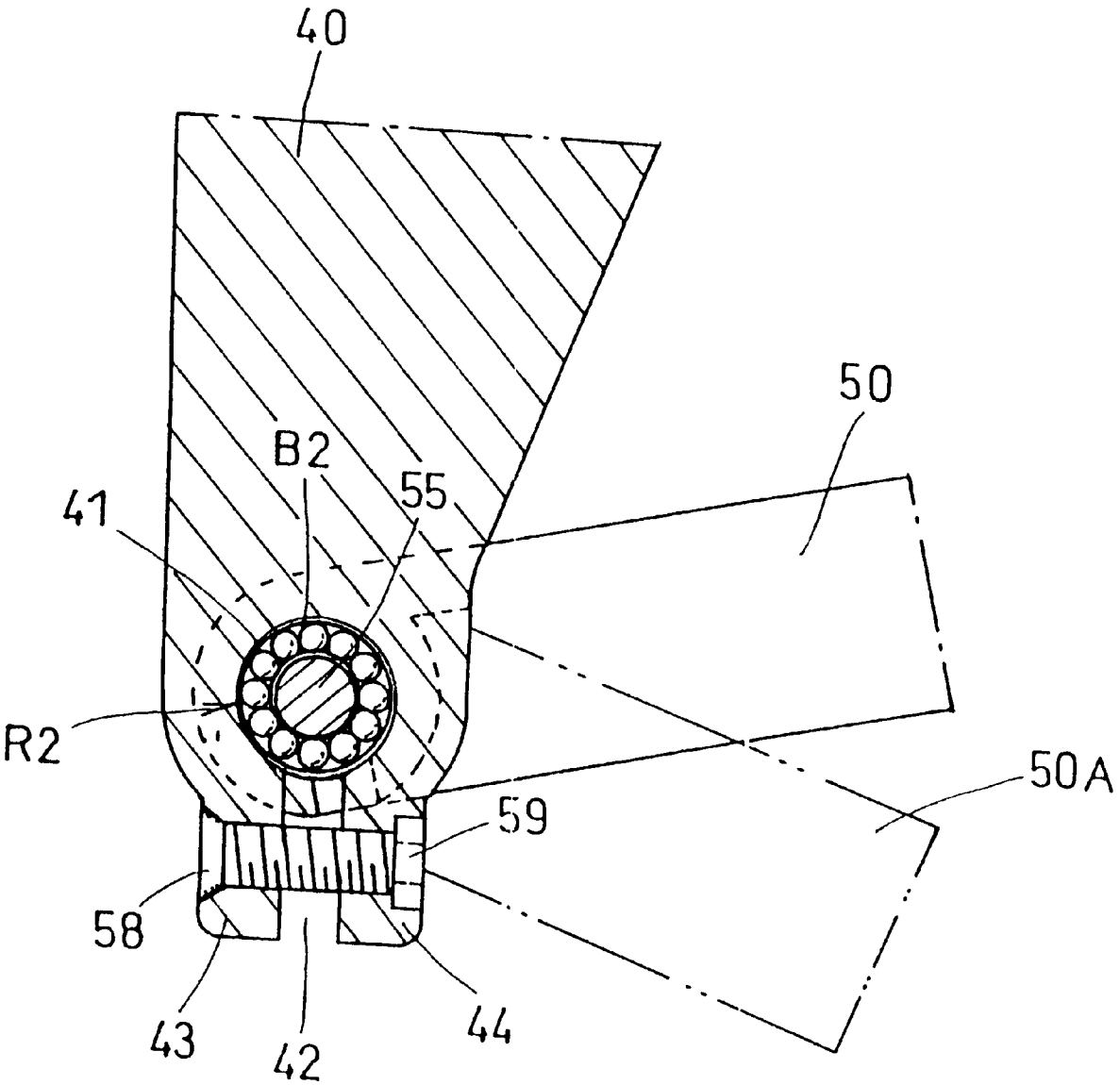
FIG. 10 is a cross section of the essential part showing a second bearing support in the rotary support member.

As seen in FIGS. 8 and 9, at the bearing B1 of this foot pedal, a forwardly directed cut 31 is provided in the support body 32, extending from an edge of the body, through the body and into the bearing holding hole 30 at the rear of the pedal plate 21, whereby there is a split ring wall of the body 32 around the periphery or outer bearing B1. Bearing B1 with the foot pedal rotary shaft 25 installed is inserted into the respective hole 30 in the body at each end of the shaft. A bearing securement bolt 38 is inserted into the free arm 33 and into the main body 32 of the plate or the two arms that define the cut 31. The arms are compressively tightened by a nut 39 on the bolt around the periphery of the bearing B1 for fixing the bearing B1.

The bearing holding hole 30 having the cut part 31 has a large enough diameter to permit insertion of the bearing B1, and the dimension of the hole does not have to be highly accurate with reference to the diameter of the periphery of the bearing B1.

There is a bolt insertion hole 34 in the main body 32 and an aligned bolt insertion hole 35 in the free arm 33. These holes terminate in a respective concave 34*a* and 35*a* for accommodating the head of the tightening bolt 38 and the nut 39.

The rotary axial part R1 of the foot pedal enables accurate holding of the bearing B1 without shakiness and prevents any shifting of the bearing B1 in the axial direction. This can eliminate horizontal shifting of the foot pedal 20 or power loss, thereby greatly improving the performance operability.

Figure 2:
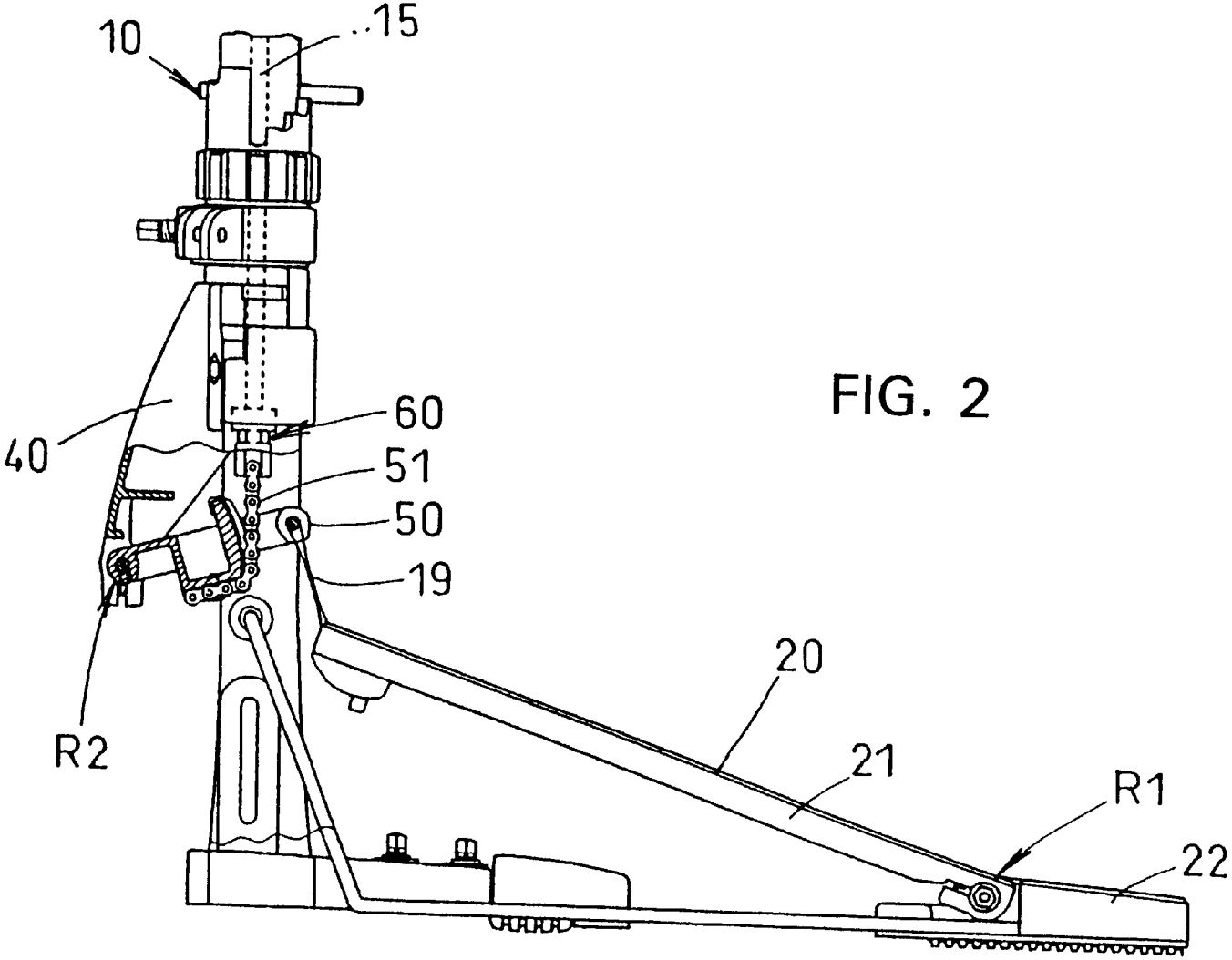
FIG. 2 is an enlarged partial cross sectional view of an essential part of FIG. 1.
Figure 3:
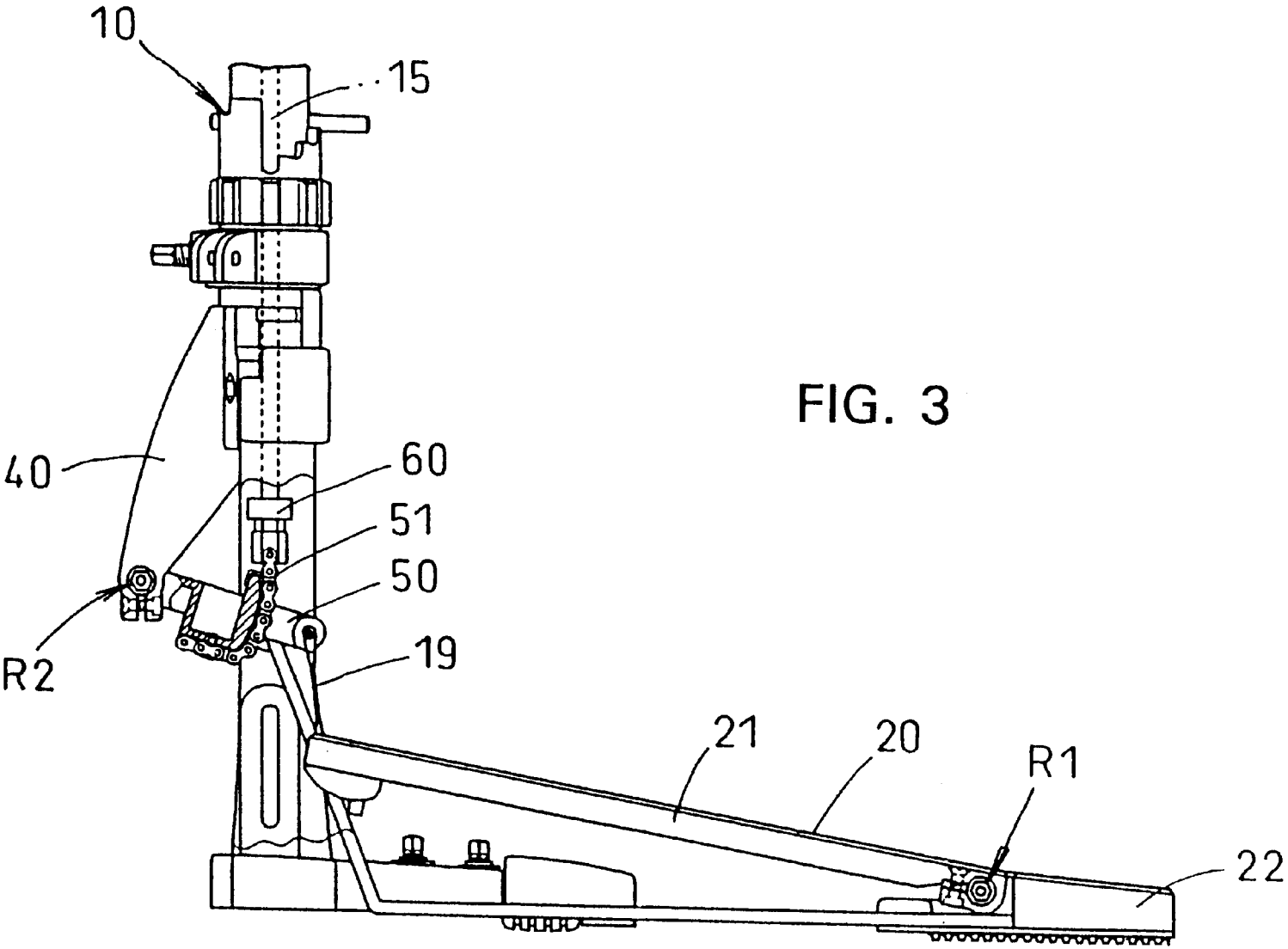
FIG. 3 is a partly cut cross section showing the operating state in which the pedal plate shown in FIG. 2 has been pressed down.

The second rotary axial part R2 of the rotary support member is explained. In FIGS. 2 and 3, the rotary element support member 40 is fixed to the pillar 11 at the upper end and freely rotatably holds the rotary arm 50 at the other end. As described above, the rotary arm 50 is linked to the foot pedal 20 through a link 19 and the arm 50 is pivoted by the up and down movement of the foot pedal 20 for, in turn, moving the cymbal operating rod 15 up and down.

The rotary support member 40 and the rotary arm 50 are connected by the rotary axis shaft 55. The shaft 55 is fixed to the rotary arm 50 and is freely rotatably held at the rotary support member 40 through the bearings B2 at opposite ends of the shaft 55. FIG. 3 shows the position of the rotary arm 50 when the foot pedal 20 is being stepped on.

At the rotary axial part R2, a cut 42 is formed in from the edge of the body of rotary support member 40 into the hole receiving each bearing for defining two free arms 43 and 44 on the tip side of the holding hole 41. The bearing B2 is inserted into the hole 41 and is there compressively clamped and held by the tightening bolt 58 and the nut 59, where the bolt is passed through one free arm 43 to the other free arm 44, to squeeze closed the cut 42 and clamp the periphery of the bearing.

The rotary shaft 55 enables smooth rotary operation of the rotary arm 50 by the foot pedal 20, making it possible to accurately transmit the action of the foot pedal 20 without waste to the operating rod 15.

Figure 11:
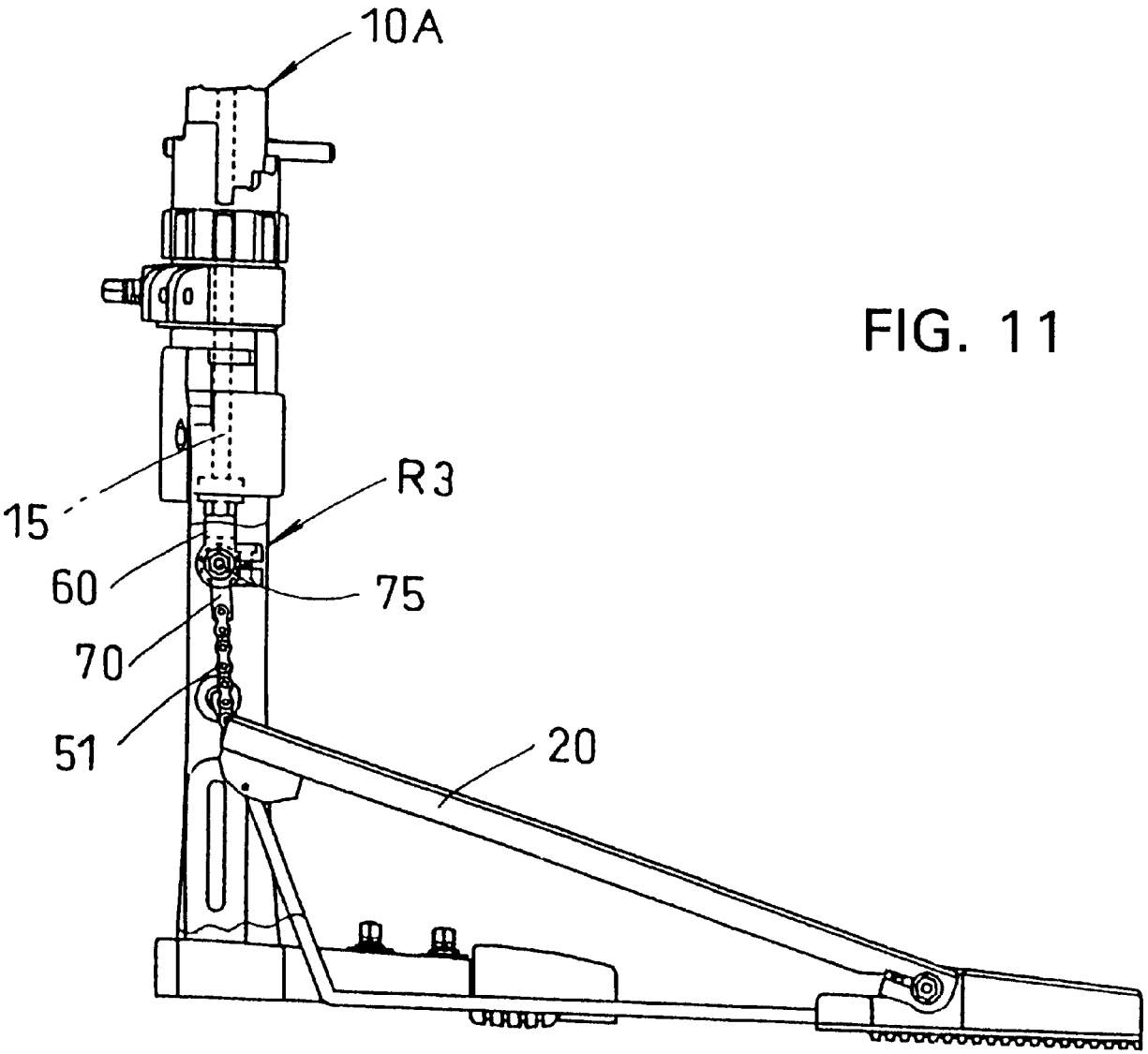
FIG. 11 is a partial cross section of a third bearing support high hat stand.

The third rotary axial part R3 is explained. It includes a rotary axis shaft 75 that uses a bearing B3 at the operating rod linkage in a high hat stand 10A of FIG. 11. The same reference numbers are used as in this example to indicate the same elements.

The operating rod 15 moves the upper movable cymbal 17 up and down through operation of the foot pedal 20, as described above. The lower end of the operating rod 15 is fixed to the operating rod link 60 and is also connected to the end of a flexible chain 51 that is engaged with the tip of the foot pedal 20 through a connecting member 70. The connecting member 70 changes the rotary or swinging movement of the chain 51 into vertical movement of the operating rod link 60 for transmission. Therefore, the member 70 is linked through the rotary axis shaft 75.

Figure 12:
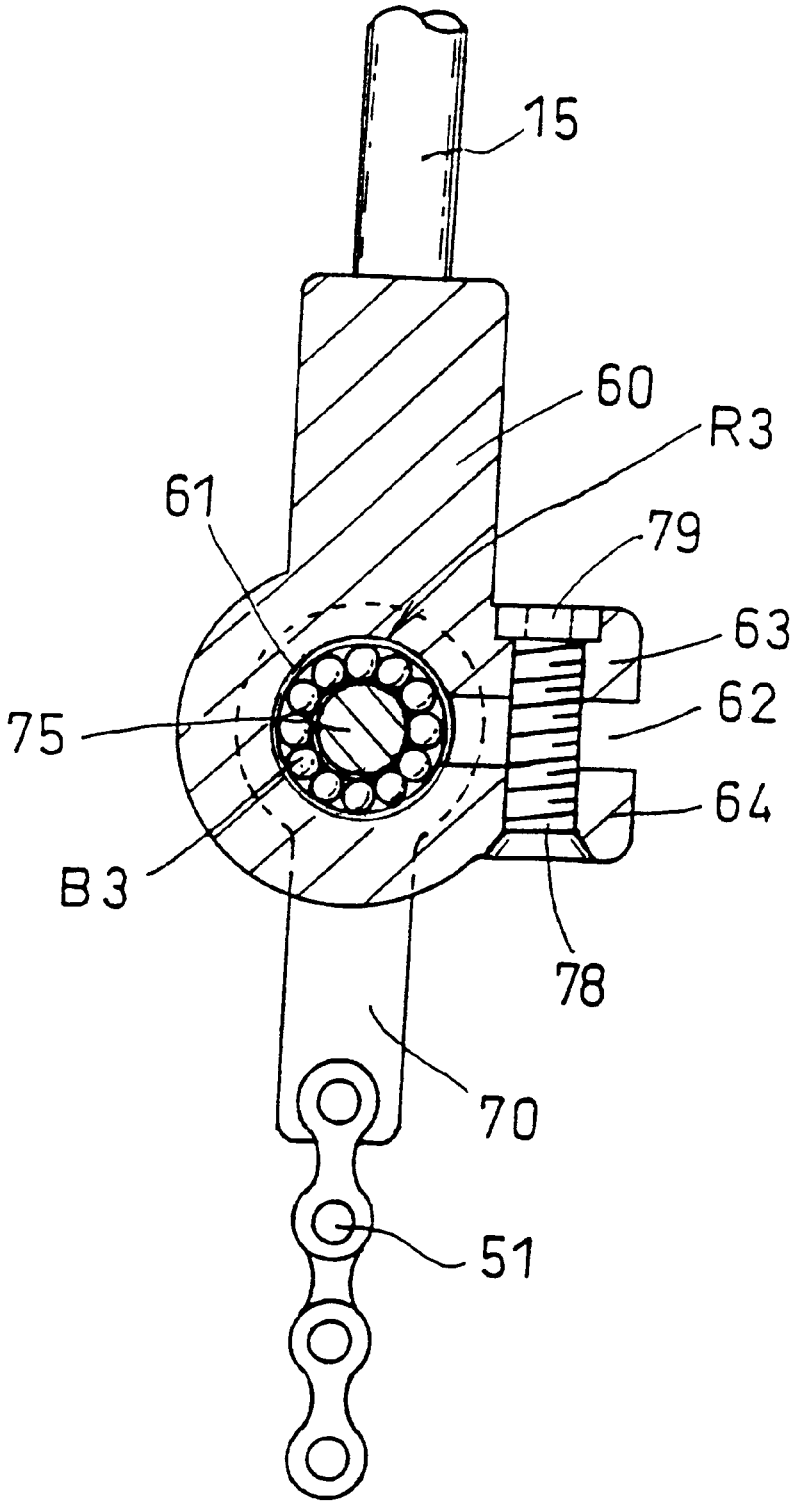
FIG. 12 is a cross section of an essential part showing the bearing support at the operating rod connecting part.

The shaft 75 of the operating rod link 60 is maintained freely rotatable by the bearing B3 in FIG. 12. This bearing B3 is provided in the bearing holding hole 61 of the operating rod link 60 in the same manner as described above. A cut 62 extends into the link 60 from one lateral side and into the hole 61. The cut 62 defines two free arms 63 and 64 which are compressively tightened by the tightening bolt 78 and nut 79 to reduce the holding hole 61 and clamp around the periphery of the bearing B3.

At the rotary shaft 75 of this operating rod linkage, the rotation of the foot pedal 20 is smoothly transmitted to the operating rod link 60 by the shaft 75 of the operating rod link 60 and the connecting member 70 which is freely rotatable around the shaft 75 by the bearing B3.

According to the structures at the rotary axial parts R1, R2 and R3 at the three locations, each bearing B1, B2 and B3 can be held accurately and firmly without shifting in the axial direction of the bearing and without producing a gap between the bearing and the holding hole in the link supporting the bearing.

This bearing holding structure can be used for a high hat stand, and also can be used for other musical instruments. The structure at the rotary axial part R1 at the foot pedal, in particular, can be used for a drum pedal, etc. in its present form.

In the bearing holding part of this invention, a bearing is compressively tightened and held by a tightening bolt in a holding hole defined by a bearing holding member having a cut for defining two arms that can be drawn together to clamp the bearing in place. As a result, even a bearing of a small diameter can be held without shakiness, and the bearing that has been securely held can be easily removed. Precise control over the respective sizes of the bearing and the holding hole for the bearing in another member are not critical for securing the bearing.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A bearing support for supporting for supporting a bearing in an object, the bearing support comprising:

a bearing having an external periphery a shaft inside the bearing, bearing rolling elements between the periphery of the bearing and the shaft for enabling relative rotation between the shaft and the periphery;

a support body in which the bearing is disposed, the support body having a bearing holding hole which is large enough to receive the bearing periphery and surrounding the bearing periphery and the bearing holding hole being defined by a wall for being tightened against the bearing periphery to hold the bearing periphery in the body;

the body having an edge, a cut into the body extending from the edge of the body into the hole for the bearing for defining a first and a second arm of the body at the sides of the cut;

a bearing clamping device engaging the arms at the sides of the cut for drawing the arms together and clamping the wall of the hole in the body against the periphery of the bearing for holding the bearing.

2. The bearing support of claim 1, wherein the clamping device comprises a bolt extending through the arms and a nut tightenable on the bolt, whereby tightening the nut onto the bolt draws the arms against the periphery of the bearing.

3. The bearing support of claim 1, wherein the bearing is a ball bearing and the shaft defines the inner race of the bearing.

4. The bearing support of claim 3, wherein the shaft has opposite ends and a respective end region backing from each end; at least one end region being stepped, the bearing being shaped for resting against the step at the one end region;

a threaded securement at the one end region near to the respective end and a nut tightenable onto the threaded securement for holding the bearing against the step at the shaft.

5. The bearing support of claim 1, further comprising another body to which the shaft is affixed and the other body and the support body being movable relative to each other around the axis of the shaft as permitted by the bearing.

6. In combination, the bearing support structure of claim 5 and a musical instrument in which the bearing support is disposed, wherein the musical instrument includes a first portion connected with the support body and a second portion connected with the other body and the musical instrument is supported on one of the bodies;

a structure for operating the musical instrument and supported on one of the bodies, the operating structure being movable with respect to the instrument at the bearing, and the bearing permitting the instrument operating structure to be operable to operate the instrument by pivoting the operating structure around the axis of the shaft.

7. In combination, the bearing support of claim 5 and a musical instrument operable by operating a pedal;

the musical instrument including a pedal which comprises one of the support bodies and the other of the bearing support structure, the pedal having a support which comprises the other one of the support bodies, the pedal being pivotable about the axis of the shaft of the bearing and the pedal being connectable to the musical instrument for operating the musical instrument as the pedal pivots.

8. In combination, the bearing support structure of claim 5 and a pedal operated musical instrument;

wherein the musical instrument operable by a pedal; a base, a pedal supported to the base and movable with respect to the base for operating the musical instrument;

a swingable arm support and a swingable arm carried on and swingable by the swingable arm support; the pedal being connected at the swingable arm for swinging the swingable arm;

the pivot bearing being between the swingable arm and the support, whereby operation of the pedal swings the swingable arm with respect to the support;

the swingable arm support comprises one of the support and the other bodies of the bearing support and the swingable arm comprises the other of the support and the other body, and the bearing enabling the arm to swing with respect to the bearing support;

the musical instrument including an operating part and a connection between the operating part and the arm such that swinging of the arm operates the operating part of the musical instrument.

9. The combination of claim 8, further comprising a flexible connecting element between the musical instrument and the arm, such that swinging of the arm correspondingly moves the instrument for operating the instrument.

10. The combination of claim 9, wherein the flexible connection comprises a chain attached to the swinging arm and the instrument includes a shaft connected with the chain and the shaft being connected with the instrument so that swinging of the arm draws on the chain which moves the shaft for operating the instrument.

11. The combination of claim 10, wherein the instrument comprises a movable cymbal connected with the shaft.

12. The combination of claim 10, the bearing support and a musical instrument operable by operating a pedal;

the musical instrument including a pedal which comprises one of the support bodies and the other of the bearing support structure, the pedal having a support which comprises the other one of the support bodies, and the other pedal being pivotable about the axis of the shaft of the bearing and the pedal being connectable to the musical instrument for operating the musical instrument as the pedal pivots.

* * * * *